US006661414B1

(12) United States Patent
Miyamoto

(10) Patent No.: US 6,661,414 B1
(45) **Date of Patent: *Dec. 9, 2003**

(54) DISPLAY SYSTEM WITH A DISPLAYING APPARATUS THAT TRANSMITS CONTROL INFORMATION

(75) Inventor: Katsuhiro Miyamoto, Isehara (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/917,468

(22) Filed: Aug. 26, 1997

(30) Foreign Application Priority Data

Aug. 29, 1996 (JP) ..... 8-228521

(51) Int. Cl.[7] ..... G09G 3/36
(52) U.S. Cl. ..... 345/213; 345/99
(58) Field of Search ..... 345/97, 125, 127, 345/131, 133, 136, 10, 11, 132, 213, 99; 323/318; 395/286

(56) References Cited

U.S. PATENT DOCUMENTS 5,285,197 A 2/1994 Schmidt et al.
5,353,041 A 10/1994 Miyamoto et al.
5,420,603 A 5/1995 Tsuboyama et al.
5,457,473 A * 10/1995 Arai et al. ..... 345/10
5,627,457 A * 5/1997 Ishiyama et al. ..... 323/318
5,652,845 A * 7/1997 Arai et al. ..... 395/286
5,821,910 A * 10/1998 Shay ..... 345/99

FOREIGN PATENT DOCUMENTS

| | | |
|---|---|---|
| EP | 0 427 546 | 5/1991 |
| EP | 0 571 146 | 11/1993 |
| EP | 0 612 053 | 8/1994 |
| EP | 0 655 525 | 8/1995 |

* cited by examiner

*Primary Examiner*—Steven Saras
*Assistant Examiner*—Srilakshim K. Kumar
(74) *Attorney, Agent, or Firm*—Fitzpatrick, Cella, Harper & Scinto

(57) ABSTRACT

A display system is constructed by a display apparatus having a display for displaying an image regarding input video data, a memory to store control information indicative of a frame rate of video data which can be displayed by the display, and a communicating unit for transmitting the control information stored in the memory. An image processing apparatus receives the control information transmitted from the display apparatus and for supplies the video data to the display apparatus in accordance with the received control information.

24 Claims, 4 Drawing Sheets

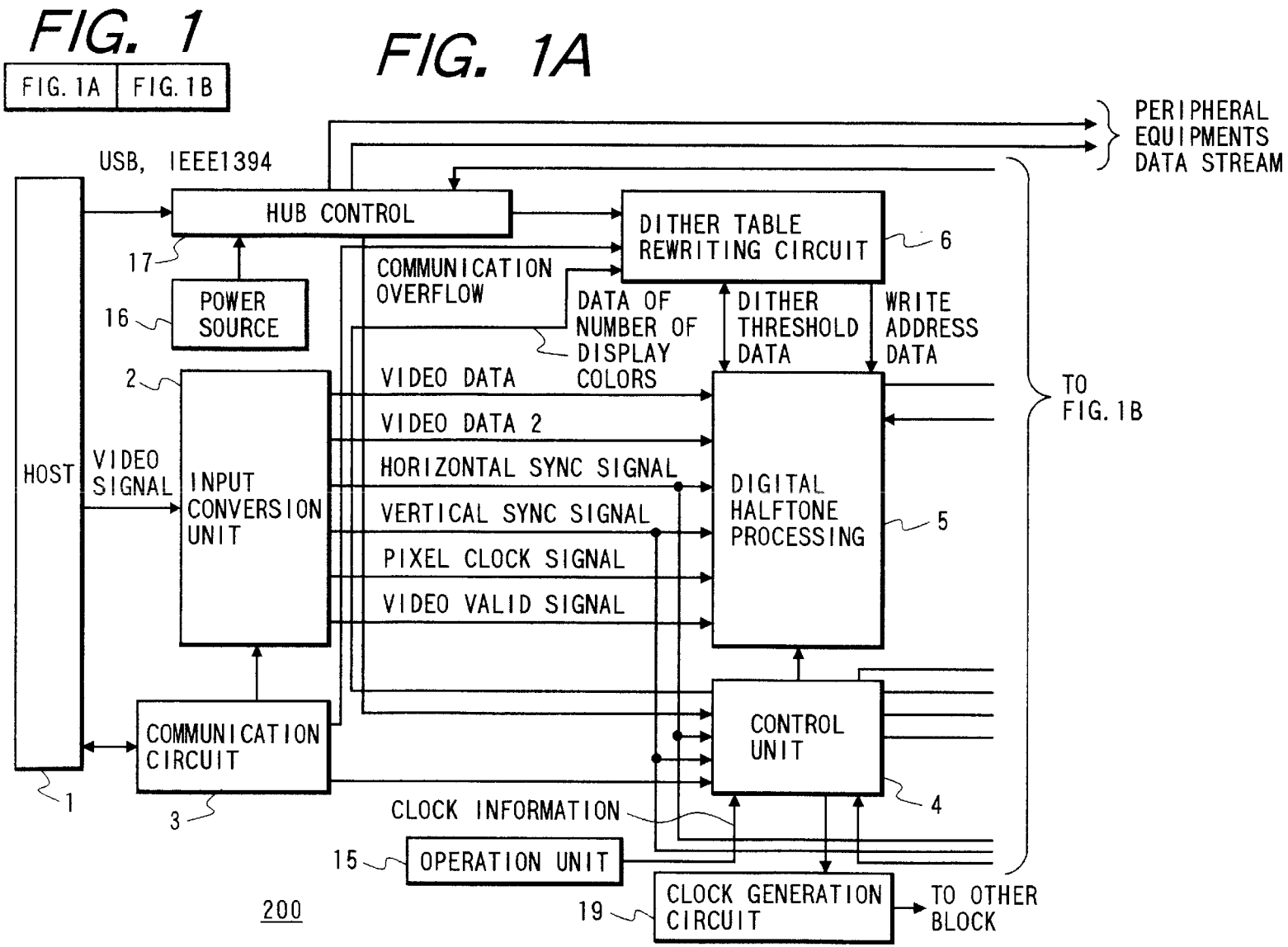
FIG. 1
FIG. 1A
FIG. 1B
PERIPHERAL EQUIPMENTS DATA STREAM
TO FIG. 1B
USB, IEEE1394
HUB CONTROL
17
POWER SOURCE
16
COMMUNICATION OVERFLOW
DITHER TABLE REWRITING CIRCUIT
6
WRITE ADDRESS DATA
DITHER THRESHOLD DATA
DATA OF NUMBER OF DISPLAY COLORS
VIDEO DATA
VIDEO DATA 2
HORIZONTAL SYNC SIGNAL
VERTICAL SYNC SIGNAL
PIXEL CLOCK SIGNAL
VIDEO VALID SIGNAL
DIGITAL HALFTONE PROCESSING
5
CONTROL UNIT
4
CLOCK INFORMATION
OPERATION UNIT
15
CLOCK GENERATION CIRCUIT
19
TO OTHER BLOCK
INPUT CONVERSION UNIT
2
VIDEO SIGNAL
COMMUNICATION CIRCUIT
3
HOST
1
200

DISPLAY SYSTEM WITH A DISPLAYING APPARATUS THAT TRANSMITS CONTROL INFORMATION

BACKGROUND OF THE INVENTION

1. Field of the Invention

The invention relates to a display system and, more particularly, to a process of video data which is supplied from an external image processing apparatus and a display of an image regarding the video data.

2. Related Background Art

In such a kind of apparatus, in recent years, when displaying an image regarding image data outputted from a computer, the realization of a high resolution, the registration of a display of a multicolor, and the realization of a variety of kinds have been being progressed.

For example, there is an apparatus in which the number of display colors is also set to 16.70 millions. There are a variety of kinds of [640 (horizontal display dots)×480 (vertical line dots)], [800×600], [1024×768], [1280×1024], and [1600×1280]. A resolution is also high.

In proportion to an increase in resolution, a transfer clock of a video signal which is transmitted from a host computer to a display device is also high.

For example, in case of [1280×1024], a transfer clock is set to 157.5 MHz at a frame rate (the number of frames per unit time) of 85 Hz. In case of [1600×1200], a transfer clock is set to 229.5 MHz at a frame rate of 85 Hz.

There is a tendency such that the frame rate is rising in order to reduce flickering. Further, there is considered that a frequency of a pixel clock rises.

However, if the resolution and the frame rate are merely raised as mentioned above, the following problems occur.

First, when video data is received and processed by a pixel clock of a high frequency, a heat generation of an IC for performing a process increases and the process cannot be accurately performed. When the user intends to execute a process at a high precision, very high costs are required.

In case of receiving video data by a pixel clock of a high frequency, if the video data is received by a long cable, many radiation noises in a high band are generated, and a legal restriction cannot be cleared.

Such a problem becomes a large problem, particularly, in case of displaying by a flat panel display.

SUMMARY OF THE INVENTION

It is an object of the invention to solve the problems as mentioned above.

Another object of the invention is to transmit image data in accordance with an ability of a display device, thereby enabling good process and display to be executed.

To accomplish the above objects, according to an embodiment of the invention, there is provided a display apparatus comprising: display means for displaying an image regarding video data which is supplied from an image processing apparatus; storage means for storing control information indicative of a frame rate of video data which can be displayed by the display means; and communicating means for transmitting the control information read out from the storage means to the image processing apparatus.

The above and other objects and features of the present invention will become apparent from the following detailed description and the appended claims with reference to the accompanying drawings.

DETAILED DESCRIPTION OF THE PREFERRED EMBODIMENT

An embodiment of the invention will now be described in detail hereinbelow with reference to the drawings.

Figure 1B:
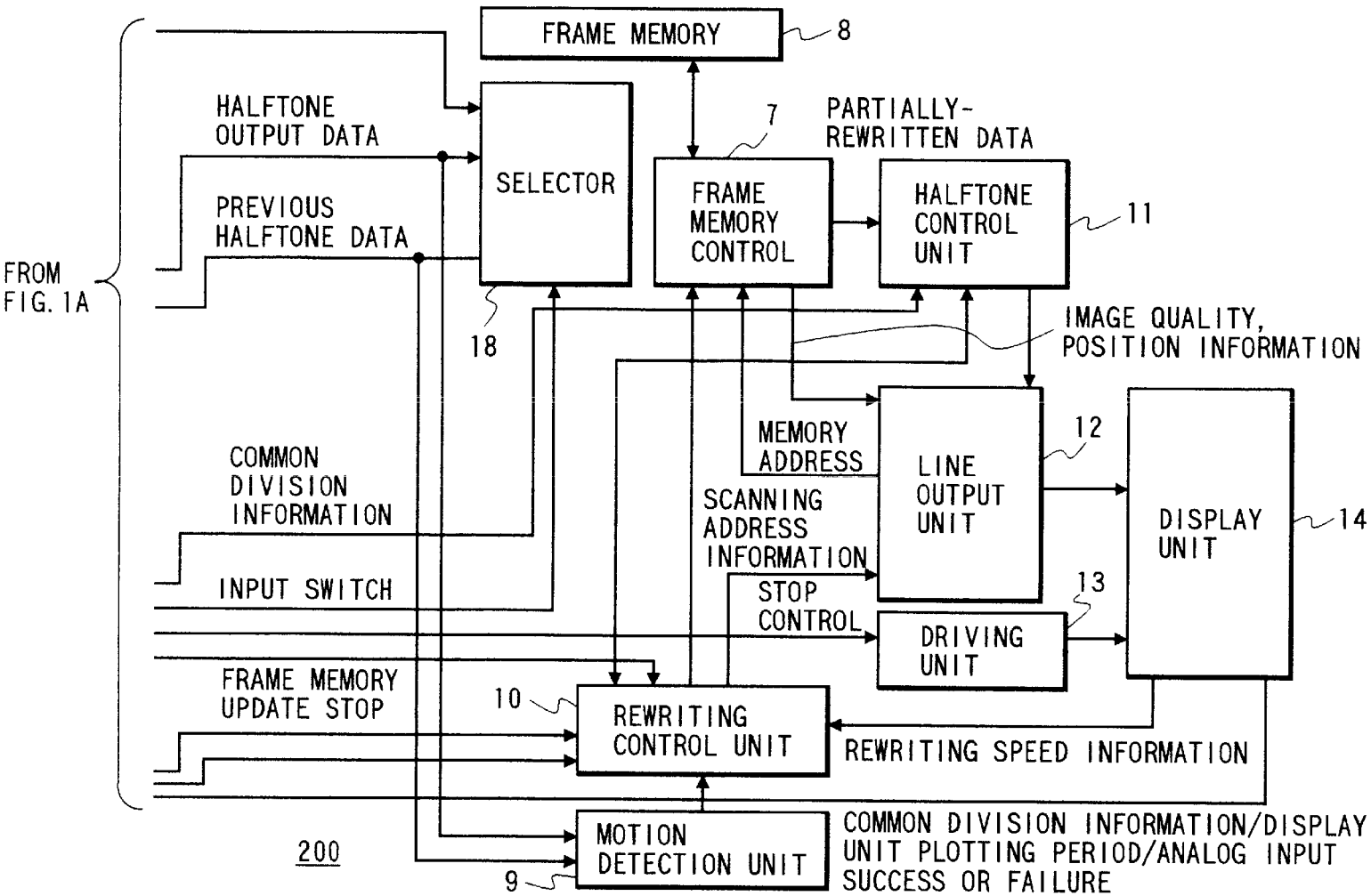
FIG. 1 which is composed of FIGS. 1A and 1B are diagrams showing a construction of a display system as an embodiment of the invention.

FIGS. 1A and 1B are block diagrams showing a construction of a display system according to the invention.

The system shown in FIGS. 1A and 1B in the embodiment comprises: a host 1 to supply video data; and a display device 200 for receiving the video data from the host 1 and displaying an image regarding the video data.

Functions of respective sections in FIGS. 1A and 1B will be first described.

Reference numeral 1 denotes the host for supplying the video data to the display device 200 and is mainly made up of a personal computer, a workstation, or a television. Reference numeral 2 denotes an input conversion unit having: a function for receiving the video data outputted from the host 1 and separating horizontal and vertical sync signals from the received video data; a function for converting analog data (for example, assuming that the input video data is analog data) into digital data; a demultiplexing function for separating the video data so that it can be processed in parallel in accordance with a transfer speed of the video data; a function for detecting interlaced data in the case where the host 1 outputs the interlaced data as in a television or the like; and a function for identifying a field number in the case where the video data constructs one frame by a plurality of fields.

Now, assuming that the input data is digital data, in the case where those digital data have been multiplexed with respect to the time to thereby reduce the number of transfer lines, a decoder for returning the multiplexed data to the original data and a PLL for generating a sampling clock of the multiplexed data are included.

In the case where the display device can receive any two or more of analog video data, digital video data, and television data (NTSC, PAL, or the like), selection data to select which data is inputted is generated from the host 1 and is received by a control unit 4 under the control of a communication circuit 3 or a hub control unit 17. The selection data is outputted from the control unit 4 to the input conversion unit 2.

The input conversion unit 2 switches the input video data in accordance with selection information from the control unit 4.

The communication circuit 3 receives information regarding the video data which is supplied from the host 1, for example, pixel clock frequency information, frame rate information, identification information of interlace/non-interlace, gamma correction data, brightness, contrast, picture plane position information, display mode (display dots, the number of lines) information, foregoing identification information of the video data, and the like.

Information of the frame rate of the video data which can be displayed in the display device 200 and information of a blanking period are transmitted to the host 1.

The data communication between the host 1 and communication circuit 3 is executed by using a two-way serial communication.

Reference numeral 4 denotes the control unit for controlling the display device. The control unit 4 can perform an arithmetic operating process by a microprocessor and can transfer input and output data. Reference numeral 5 denotes a digital halftone processing unit for dither processing input video data; 6 a dither table rewriting circuit for rewriting a multivalue dither table and a dither threshold value table in the digital halftone processing unit; 7 a frame memory control unit for writing and reading dither halftone data into/from a frame memory 8 and for reading data of a desired line from the memory as will be explained hereinlater in accordance with an instruction of a rewriting control unit 10; 9 a motion detection unit for comparing dither halftone data of the previous frame with dither halftone data outputted at present, thereby detecting a motion; 10 the rewriting control unit for controlling the reading operation of the memory in accordance with a motion detection result by the motion detection unit 9 and rewriting speed information from a display unit 14 in a manner such that an image which is displayed on the display unit is rewritten on a line unit basis; 11 a halftone control unit for processing gradation data in the case where a pixel has been divided into two or more portions to the common side (horizontal direction); 12 a line output unit for adding a scanning address indicative of a display position on the display unit 14 to the image data and for transferring the resultant image data to the display unit 14; 13 a driving unit which is controlled by the control unit 4 e and line output unit 12 and drives the display unit 14; and 14 the display unit having a matrix configuration and comprising a display panel which is made of ferroelectric liquid crystal having a memory performance, a driving circuit, a back light, and the like. The display unit 14 has therein an ROM in which data that indicates the number of colors which can be displayed, a resolution of a panel, a data transfer period (corresponding to a frame period of the panel) which is necessary for the display unit 14, and the like and that is peculiar to each display unit has been stored. This data is outputted to the control unit 4. Reference numeral 15 denotes an operation unit having knobs which are used for the user to adjust a picture quality and a position of a picture plane and a switch to switch the on/off operations of a power source.

Reference numeral 16 denotes a power source and 17 indicates the hub control unit for supplying video data or the like from the host 1 to the display device and peripheral equipment connected to the display device.

The hub control unit 17 has a USB (Universal Serial Bus) in which the use has recently been being examined and an interface according to IEEE1394 as a standard of a high speed serial bus interface. The hub control unit 17 includes a switch to supply the data to the display device and peripheral equipment connected to the display device, a decoder of each data, an interface with an external equipment, and the like.

Reference numeral 18 denotes a selector for allowing the data received by the hub control unit 17 to be written into the memory 8 and to be displayed. Reference numeral 19 denotes a clock generation circuit for generating an operating clock that is necessary for processing the video data in the display device. A frequency of the clock generation circuit is controlled by the control unit 4.

A display operation of the system in FIGS. 1A and 1B will now be described.

When the power source is turned on by the operation of the operation unit 15, the control unit 4 reads out information regarding the data indicative of the number of display colors which can be displayed by the display unit 14 (this data includes common division number data), a resolution, and data transfer period (depending on the frame period of the panel) which is necessary for the display unit 14 from the ROM provided in the display unit 14.

On the basis of that information, the control unit 4 calculates the minimum frame rate which can be received by the display device and a blanking period and transmits that information to the host 1 through the communication circuit 3. In the embodiment, the information indicative of the frame rate is transmitted to the host 1 in accordance with the power-on of the display device 200 and, after that, it is never transmitted at timings other than the case where the power source of the display device 200 is again turned on or where there is a request from the host at the time of a change of the host.

The information of the pixel clock, frame rate, and blanking period which is transmitted from the host 1 as mentioned above is received by the communication circuit 3. The control unit 4 calculates a clock for processing on the basis of that data and controls the clock generation circuit.

When the information as mentioned above is not received from the host 1, it is also possible to use a default value (maximum system clock) or a frame rate and blanking information which have previously been held in the control unit 4 or a frame rate and a blanking value which were set by the user via the operation unit 15.

The control unit 4 outputs necessary data to the dither table rewriting circuit 6 and halftone control unit 11, respectively.

The dither table rewriting circuit 6 selects a dither threshold value that is necessary for the necessary number of display colors from a table which has been prepared or calculates by arithmetically operating a necessary table and rewrites the dither threshold value table in the digital halftone processing unit 5.

In this instance, the number of input bits can be predetermined or can be determined by receiving such information from the host 1 by the communication circuit 3. It is also possible to calculate a display mode in the input conversion unit 2 by using a horizontal sync signal and to use input bits.

A rewriting timing of the dither table is not limited to the timing when the power source is turned on by the operation unit 15. The dither table can be also rewritten when the display unit is changed, the host is changed, or the display mode is changed.

After completion of the rewriting of the dither table, the video data supplied from the host 1 is first converted to the data of a format adapted to processes at the post stage by the input conversion unit 2.

That is, for example, assuming that the input video data is the analog video data for a CRT as mentioned above, it is converted into the digital data. In case of differential digital data, it is converted to the data of a TTL level or a CMOS level. When a transfer frequency of the input video data is high, for example, when it exceeds 100 Hz, the video data is demultiplexed, thereby reducing the transfer frequency to the half frequency.

When the input video data is an interlaced signal like a television signal, its discrimination signal and an identification signal of a field number are outputted.

As mentioned above, although a plurality of video data are supplied to the input conversion unit 2, any one of them is selected by the information derived by the communication circuit 3 or hub control unit 17 and is supplied to the digital halftone processing unit 5.

The video data which was dither processed by the digital halftone processing unit 5 is written into the memory 8. The video data which is written in the memory 8 is sequentially updated so long as the writing operation is not inhibited by the control of the rewriting control unit 10.

On the other hand, the dither processed video data is also outputted to the motion detection unit 9. The video data of one frame before is also supplied from the memory 8 to the motion detection unit 9 synchronously with the output of the video data from the halftone processing unit 5. The motion detection unit 9 obtains a difference between the video data of the inputted two frames on a pixel unit basis. When the differential value exceeds a certain threshold value th, such a portion is detected as being a portion with a motion (hereinafter, such a portion is also referred to as a moving portion).

The detection result of the motion detection unit 9 is outputted to the rewriting control unit 10 and the rewriting control unit 10 controls the memory control unit 7 so as to read out the portion with the motion from the memory 8. The memory control unit 7 reads out the video data of the moving portion and supplies to the halftone control unit 11.

When the moving portion is not detected by the motion detection unit 9, in order to refresh the whole picture plane, the rewriting control unit 10 controls the memory control unit 7 so as to read out the video data from the memory 8 in a multi interlacing or random interlacing manner.

In case of a display device without flickering, the refreshing operation can be also performed in a non-interlacing manner.

The video data read out from the memory 8 as mentioned above is outputted to the halftone control unit 11. The halftone control unit 11 converts the video data in accordance with the common division number information outputted from the control unit 4 and supplies the converted data to the line output unit 12.

The line output unit 12 adds scanning address information which is outputted from the rewriting control unit 10 to the video data and supplies the resultant data to the display unit 14. The scanning address information is data indicative of a moving portion designated for the memory 8 by the rewriting control unit 10.

The line output unit 12 outputs data indicative of a writing timing of the display unit 14 to the driving unit 13. The driving unit 13 forms a driving signal for driving the display unit 14 in accordance with its timing and supplies it to a driver IC in the display unit 14.

The display unit 14 rewrites an image of the line designated by the scanning address on the basis of the video data supplied from the line output unit 12, the scanning address data, and the driving signal which is supplied from the driving unit.

According to the embodiment as mentioned above, prior to displaying the image, the frame rate at which the image can be displayed by the display device and the data indicative of the blanking are transmitted to the host 1 and the host 1 generates the video data in accordance with the frame rate and blanking data which were transmitted from the display device.

The specific operation of the host 1 such that the information such as frame rate, blanking, and the like from the display device is received and the video data is outputted will now be described.

Figure 2:
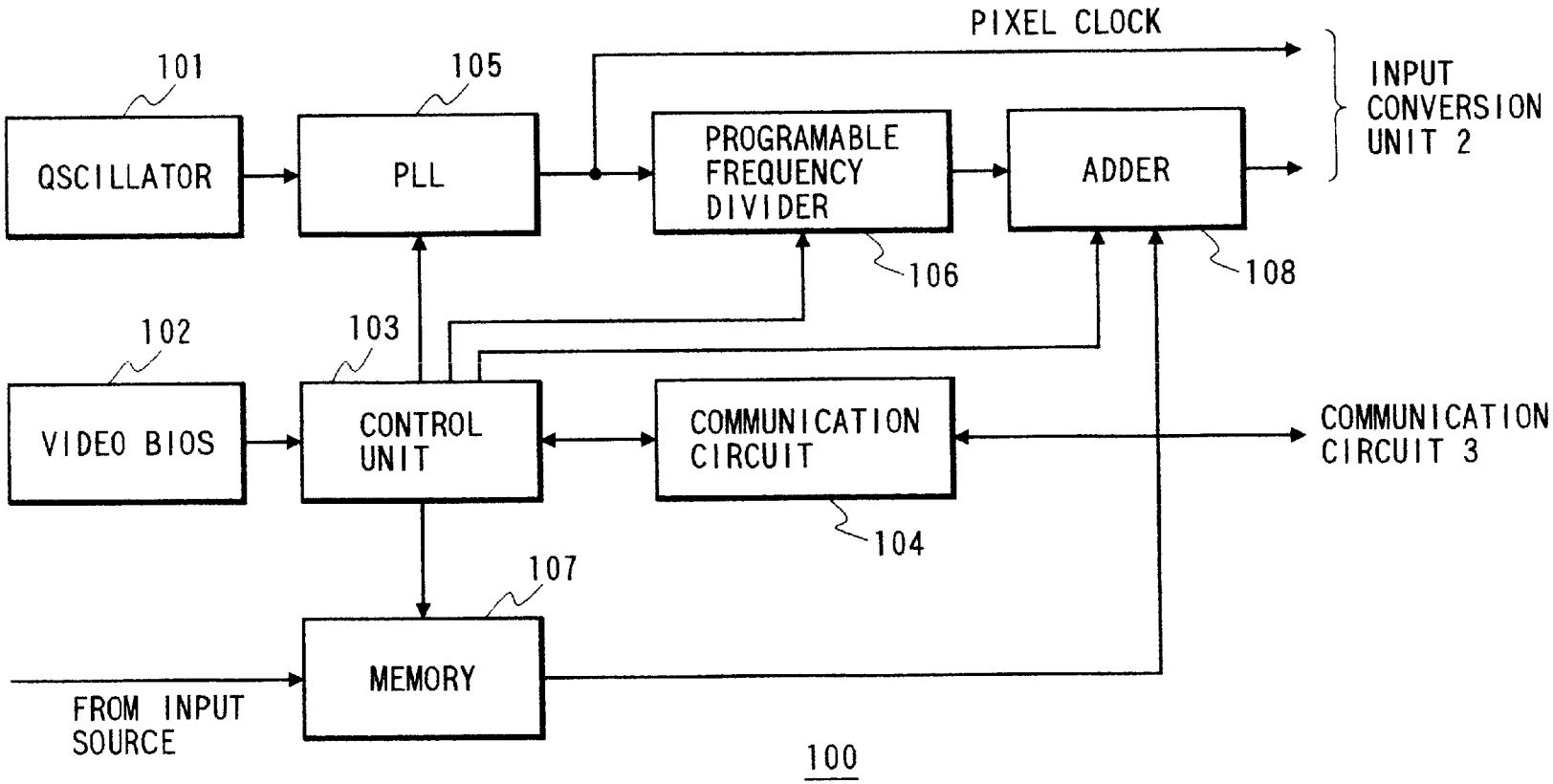
FIG. 2 is a diagram showing a construction of a graphic controller in a host in FIGS. 1A and 1B.

FIG. 2 is a block diagram showing a construction of a graphic controller 100 which is provided in the host 1 and controls the operation to supply the image data to the display device 200. The graphic controller of FIG. 2 is connected to the input conversion unit 2 and communication circuit 3 in FIGS. 1A and 1B by a connector (not shown).

In FIG. 2, the frame rate and the blanking information transmitted from the communication circuit 3 in FIGS. 1A and 1B as mentioned above are received by a communication circuit 104 and are held in a buffer (not shown) in the communication circuit 104.

A control unit 103 calculates a frequency of the pixel clock and reads out the video data from a memory 107 on the basis of the frame rate information and the blanking information which were received by the communication circuit 104.

That is, when the received blanking period is longer than the blanking period of the video data which is treated in the host, the blanking period is set to the received blanking period. An arithmetic operation is executed as follows by using the received frame rate and, further, a resolution value that is set by the graphic controller itself, thereby calculating the pixel clock of the video data which is outputted to the display device.

There is the following relation.

$$\{(1/fp)\times rh+bh\}+bv=(1/fv)$$

where, bv: vertical blanking hv: horizontal blanking fv: frame rate (frame frequency)

fh: horizontal frequency rv: vertical resolution rh: horizontal resolution fp: pixel clock frequency The control unit 103 calculates the pixel clock so as to satisfy the above equation and changes frequency dividing ratios of a frequency divider in a PLL 105 and a programable frequency divider 106 in accordance with a calculation result.

An oscillator 101 generates a clock of a predetermined very high frequency. The PLL 105 includes a phase comparator, a counter, a loop filter, and a VCO and generates a clock whose phase is synchronized with the clock from the oscillator 101.

The control unit 103 controls the frequency dividing ratio of the frequency divider even by controlling a count value of the counter in the PLL 105 and allows a clock that is closest to the calculated pixel clock to be outputted from the PLL 105.

The frequency divider 106 frequency divides the pixel clock outputted from the PLL 105, generates a horizonal sync signal, a vertical sync signal, and an image valid signal, and supplies them to an adder 108.

On the other hand, video data from another video data input source such as video camera, tuner, or hard disk of the host 1 is supplied to the memory 107 and is sequentially written into the memory 107 by a clock according to an operating clock of the host 1.

In the reading mode, the video data is read out in accordance with the frame rate and pixel clock which were calculated by the control unit 103 as mentioned above and is supplied to the adder 108.

That is, although the video data is written into the memory 107 in response to the operating clock of the host itself, when the video data is read out from the memory 107, it is converted into the video data of the frame rate and pixel clock according to the display device.

When the calculated frame rate is lower than the frame rate of the video data to be written into the memory 107, the video data is thinned out in accordance with its ratio and is supplied to the display device.

The adder 108 adds the horizontal and vertical sync signals generated from the frequency divider 106 to the video data read out from the memory 107 and supplies the resultant data to the input conversion unit 2 in FIGS. 1A and 1B.

The pixel clock signal from the PLL 105 is also similarly supplied to the input conversion unit 2.

The control unit 103 outputs the frame rate regarding the outputted video data, the blanking, and the data regarding the pixel clock period to the communication circuit 3 in the display device through the communication circuit 104.

On the display device side, the processes as mentioned above are executed on the basis of the information transmitted in this manner and an image corresponding to the video data is displayed.

When the frame rate is not transmitted from the display device side, a frame rate and a pixel clock are calculated on the basis of data which has previously been stored in a video BIOS 102.

In the embodiment as mentioned above, the frame rate at which the image can be displayed and the blanking information are transmitted from the display device side to the host and, on the host side, the video data is supplied to the display device on the basis of the transmitted information, so that it is possible to prevent the frequency of the pixel clock of the video data to be transmitted from rising unnecessarily.

Therefore, a problem as mentioned above in association with an increase in frequency of the pixel clock doesn't occur. Even in any case, processes according to the ability that is peculiar to the display device can be executed and the video data can be accurately processed.

Figure 3:
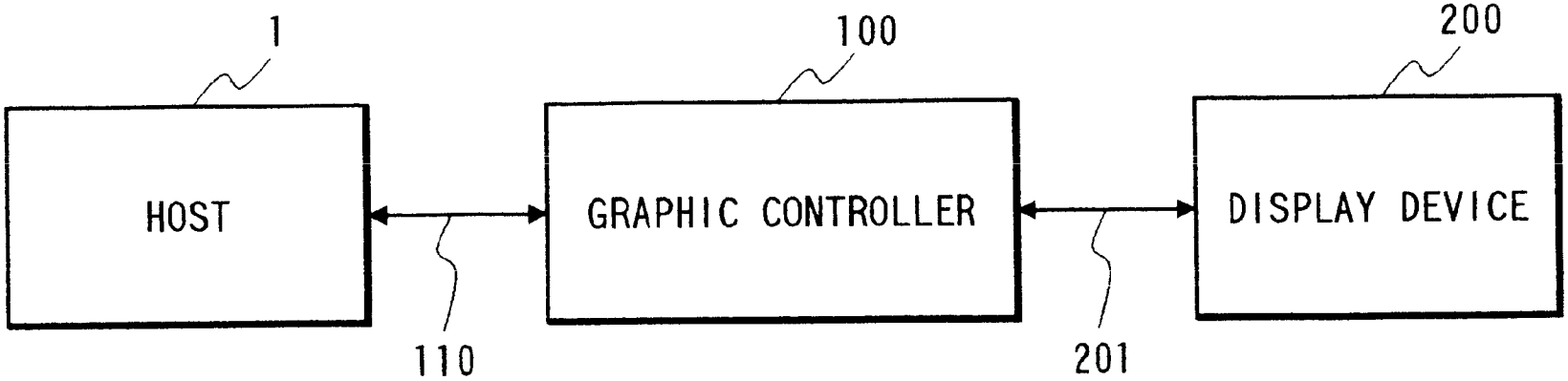
FIG. 3 is a diagram showing a construction of a display system to which the invention is applied.

In the above embodiment, the graphic controller 100 has been provided in the host 1. As shown in FIG. 3, however, it is also possible to construct such that the graphic controller 100 is provided out of the host 1 and the graphic controller 100 and host 1 can be disconnected through a cable 110.

With this construction, the foregoing function can be also provided for a host without means for receiving the frame rate information from the display device 200 as mentioned above.

In the above embodiment, the control unit 103 calculates the frequency of the clock by performing the arithmetic operation by using the information of the frame rate and the blanking transmitted from the display device. However, the invention is not limited to such a method but it is also possible to construct in a manner such that an ROM table is provided in the video BIOS 102 and the control unit 103 selects parameters regarding a plurality of clocks written in the ROM table on the basis of the inputted frame rate and blanking information.

As described above, by transmitting the frame rate of the video data which can be displayed to the image processing apparatus, the video data is not unnecessarily transmitted at a high speed.

By outputting the video data in accordance with the frame rate of the video data which can be displayed by the display device, the proper video data according to the characteristics which are peculiar to the display device can be outputted.

Many widely different embodiments of the present invention may be constructed without departing from the spirit and scope of the present invention. It should be understood that the present invention is not limited to the specific embodiments described in the specification, except as defined in the appended claims.

What is claimed is:

1. A display apparatus for displaying an image regarding video data which is generated by an external apparatus outside of said display apparatus and is supplied from outside of said display apparatus, comprising:

a display unit having a memory which stores control information indicative of a frame rate of video data which can be displayed by said display unit;

instruction means for instructing to turn on a power source for said display apparatus; and communicating means for reading the control information from said memory and for transmitting the control information read out from said memory to said external apparatus outside of said display apparatus in response to the instruction to turn on the power source by said instruction means, wherein said external apparatus determines a processing parameter of the video data on the basis of the control information transmitted thereto by said communicating means, and wherein said external apparatus includes control means for determining the processing parameter of the video data on the basis of the control information transmitted to said external apparatus by said communicating means, said control means including arithmetic operating means for performing an arithmetic operation by using the control information transmitted to said external apparatus by said communicating means and for calculating the processing parameter.

2. An apparatus according to claim 1, further comprising processing means for processing the video data, and wherein said display unit displays an image regarding the video data processed by said processing means.

3. An apparatus according to claim 2, wherein said communicating means inputs the processing parameter determined by said external apparatus and said processing means processes the video data by using the processing parameter received by said communicating means.

4. An apparatus according to claim 3, wherein said processing means has clock generating means for generating an operating clock on the basis of the processing parameter received by said communicating means, and said processing means processes the video data on the basis of said operating clock.

5. An apparatus according to claim 1, wherein said communicating means performs a two-way serial communication with said external apparatus.

6. An apparatus according to claim 1, wherein said display unit includes a flat panel display.

7. A display system comprising:

a display apparatus which displays an image regarding video data supplied from outside of said display apparatus, said display apparatus having a display unit including a memory which stores control information indicative of a frame rate of video data which can be displayed by said display unit, instruction means for instructing to turn on a power source for said display apparatus, and communicating means for reading the control information from said memory and for transmitting the control information read out from said memory outside of said display apparatus in response to the instruction to turn on the power source by said instruction means; and an external image generating apparatus which is outside of said display apparatus, said external image generating apparatus having receiving means for receiving the control information transmitted by said communicating means of said display apparatus, generating means for generating the video data suitable for said display unit of said display apparatus in accordance with the received control information, and supplying means for supplying the generated video data to said display apparatus, with said receiving means, said generating means and said supplying means arranged within said external image generating apparatus, wherein said external image generating apparatus includes control means for determining a processing parameter of the video data on the basis of said control information received by said receiving means, said control means including arithmetic operating means for performing an arithmetic operation by using the control information transmitted from said display apparatus and for calculating the processing parameter.

8. A system according to claim 7, wherein said external image generating apparatus includes clock generating means for generating a clock, and said control means controls a frequency of said clock in accordance with the processing parameter.

9. A system according to claim 7, wherein said processing parameter includes a frame rate, a blanking, and a frequency of the video data.

10. A system according to claim 7, wherein said control means includes:

a memory in which a plurality of the processing parameters have been stored; and a selector for selecting the processing parameter from the plurality of processing parameters stored in said memory on the basis of the control information transmitted from said display apparatus.

11. A system according to claim 7, wherein said receiving means transmits the processing parameter to said display apparatus.

12. A system according to claim 11, wherein said communicating means receives the processing parameter transmitted from said receiving means, and said display apparatus comprises processing means for processing the video data by using the processing parameter received by said communicating means.

13. A system according to claim 12, wherein said display apparatus includes clock generating means for generating an operating clock on the basis of the processing parameter, and said processing means processes the video data on the basis of the operating clock.

14. A system according to claim 7, wherein said communicating means and said receiving means execute a two-way serial communication.

15. A system according to claim 7, wherein said external image generating apparatus includes output means for outputting said video data to said display apparatus on the basis of the processing parameter.

16. A system according to claim 15, wherein said output means includes:

a memory for storing video data; and reading means for reading out video data from said memory in accordance with the processing parameter.

17. A system according to claim 7, wherein said display unit includes a flat panel display.

18. A display apparatus for displaying an image regarding video data which is generated by an external apparatus outside of said display apparatus and is supplied from the outside of said display apparatus, comprising:

a display unit;

instruction means for instructing to turn on a power source of said a display apparatus; and communication means for reading control information indicative of a frame rate of video data which can be displayed by said display unit from a memory and for transmitting the control information read out from said memory to said external apparatus on the outside of said display apparatus in response to an instruction to turn on the power source by said instructing means so that said external apparatus determines a processing parameter of the video data on the basis of the control information transmitted thereto by said communication means, wherein said display unit, said instruction means and said communication means are arranged within said display apparatus, and wherein said external apparatus includes control means for determining the processing parameter of the video data on the basis of the control information transmitted to said external apparatus by said communication means, said control means including arithmetic operating means for performing an arithmetic operation by using the control information transmitted to said external apparatus by said communication means and for calculating the processing parameter.

19. A display apparatus for displaying an image regarding video data which is generated by an external apparatus outside of said display apparatus and is supplied from outside of said display apparatus, comprising:

a display unit having a memory which stores frame rate information indicative of a frame rate of video data which can be displayed by said display unit; and a communicating unit which reads out the frame rate information from the memory and transmits the frame rate information read out from the memory to said external apparatus outside of said display apparatus so that said external apparatus performs an arithmetic operation by using the frame rate information transmitted from said communicating unit and calculates a processing parameter of the video data.

20. An apparatus according to claim 19, wherein said communicating unit receives the processing parameter output from said external apparatus, and said display unit displays the image regarding the video data in accordance with the processing parameter received by said communicating unit.

21. An apparatus according to claim 19, wherein the processing parameter includes a pixel clock frequency.

22. A display system comprising:

a display apparatus which displays an image regarding video data supplied from outside of said display apparatus, said display apparatus having a display unit with a memory which stores frame rate information indicative of a frame rate of video data which can be displayed by said display unit and communicating unit which reads out the frame rate information from the memory and transmits the frame rate information outside of said display apparatus; and an external image generating apparatus which is outside of said display apparatus, said external image generating apparatus having a receiving unit which receives the frame rate information transmitted by said communicating unit of said display apparatus, a control unit which performs an arithmetic operation by using the frame rate information received by said receiving unit and calculates a processing parameter of the video data, a generating unit which generates the video data suitable for said display unit of said display apparatus in accordance with the processing parameter calculated by said control unit, and a supplying unit which supplies the video data generated by said generating unit to said display apparatus, with said receiving unit, said control unit, said generating unit and said supplying unit arranged within said external image generating apparatus.

23. A system according to claim 22, wherein said generating unit generates the video data using a pixel clock generated by a clock generator and changes a frequency of said pixel clock in accordance with the processing parameter.

24. A system according to claim 22, wherein said generating unit includes storage for storing video data and reading means for reading out the video data from said storage in accordance with said pixel clock.

* * * * *

UNITED STATES PATENT AND TRADEMARK OFFICE

CERTIFICATE OF CORRECTION

PATENT NO. : 6,661,414 B1
DATED : December 9, 2003
INVENTOR(S) : Katsuhiro Miyamoto It is certified that error appears in the above-identified patent and that said Letters Patent is hereby corrected as shown below:

Drawing,
FIG 2. "QSCILLATOR" should read -- OSCILLATOR --.

Column 1,
Line 17, "been being" should be deleted.

Column 3,
Line 31, "4 e" should read -- 4 --.
Line 51, "been being" should read -- been --.

Column 9,
Line 67, "said a" should read -- said --.

Signed and Sealed this

Sixth Day of July, 2004

JON W. DUDAS
*Acting Director of the United States Patent and Trademark Office*